US008529278B2

(12) United States Patent
Shiga

(10) Patent No.: US 8,529,278 B2
(45) Date of Patent: Sep. 10, 2013

(54) WATERPROOF ELECTRICAL CONNECTOR AND WATERPROOF ELECTRICAL CONNECTOR ASSEMBLY METHOD

(75) Inventor: Katsumi Shiga, Chiba (JP)

(73) Assignee: Tyco Electronics Japan G.K., Kanagawa-Ken (JP)

( * ) Notice: Subject to any disclaimer, the term of this patent is extended or adjusted under 35 U.S.C. 154(b) by 0 days.

(21) Appl. No.: 13/206,148

(22) Filed: Aug. 9, 2011

(65) Prior Publication Data

US 2012/0034800 A1 Feb. 9, 2012

(30) Foreign Application Priority Data

Aug. 9, 2010 (JP) ..... 2010-178451

(51) Int. Cl.
*H01R 13/52* (2006.01)

(52) U.S. Cl.
USPC ..... 439/272

(58) Field of Classification Search
USPC ..... 439/271, 277, 278, 320, 587, 589, 439/693, 660, 581, 582, 604, 606, 607, 608, 439/439/609, 610, 611, 612, 613, 607.57, 439/607.58, 722, 736
See application file for complete search history.

(56) References Cited

U.S. PATENT DOCUMENTS

| | | | | |
|---|---|---|---|---|
| 5,129,843 | A * | 7/1992 | Bowsky et al. | 439/685 |
| 5,580,282 | A * | 12/1996 | Paterek | 439/685 |
| 6,699,078 | B2 * | 3/2004 | Quadir | 439/693 |
| 7,670,164 | B2 | 3/2010 | Shiga | |
| 2009/0275227 | A1 * | 11/2009 | Fujiwara et al. | 439/271 |

* cited by examiner

*Primary Examiner* — Edwin A. Leon
*Assistant Examiner* — Harshad Patel
(74) *Attorney, Agent, or Firm* — Barley Snyder

(57) ABSTRACT

The invention is directed to a waterproof electrical connector that can prevent detachment of connector parts and enhance waterproofness. The connector includes a main housing, a cover housing, a contact, and a body. The main housing includes a mating protrusion, a fitting section, and a head portion. The contact includes a contacting portion that is received in the fitting section and an electric wire connection portion that connects to one end of an electric wire. The body covers at least a boundary portion between the main housing and the cover housing. The main housing further includes an outer circumferential wall positioned on an outer circumferential side of the boundary portion between the main housing and the cover housing.

11 Claims, 5 Drawing Sheets

PRIOR ART

WATERPROOF ELECTRICAL CONNECTOR AND WATERPROOF ELECTRICAL CONNECTOR ASSEMBLY METHOD

CROSS-REFERENCE TO RELATED APPLICATIONS

This application claims the benefit of the filing date under 35 U.S.C. §119(a)-(d) of Japanese Patent Application No. JP 2010-178451 filed on Aug. 9, 2010.

FIELD OF INVENTION

The present invention relates to an electrical connector that electrically connects a wire to a mating connector, and more particularly relates to a waterproof electrical connector.

BACKGROUND

Conventionally, among electrical connectors, waterproof connectors which prevent water from entering the connecting portion with a mating connector are known. In air bag systems of automobiles an electrical signal is sent to the ignition device to cause an explosion, and the gas generated from the explosion fills the air bag. The wiring which sends the electrical signal in the air bag system is connected to the mating connector on the ignition device through an electrical connector. Recently, air bag devices have come to be installed not only in the steering portion in the interior of automobiles, but also, inside the doors as a curtain air bag or a side air bag. Since condensation or the like is more likely to be formed inside the doors compared with the interior, the connectors used inside the doors needs to be waterproof, which includes being not only "watertight" to prepare for the possibility of water coming in direct contact therewith, but also being "airtight" to prepare for the possibility of dew condensation occurring inside the electrical connectors.

As one of the aforementioned electrical connectors, for example, as shown in FIG. 4, a waterproof electrical connector 1 has been proposed in which an outer side of an insulative housing 2 is covered with a body 8 by melt molding in a state in which the insulative housing 2 holds electric wires 6 that are led out there from (for example, see Japanese Patent Laid-Open No. 2009-200010).

In the waterproof electrical connector 1, as shown in FIG. 5, the insulative housing 2 comprises a main housing 3 and a cover housing 4 which are both made of an insulating synthetic resin. The main housing 3 has a fitting section 5 that receives a contact, and an electric wire end covering section 7 that projects in a direction in which the electric wires 6 project, and that receives a connecting portion between a contact and the electric wires. Further, the fitting section 5 of the main housing 3 includes an opening for inserting a contact from an end on an opposite side to a side facing the mating connector. The cover housing 4 is positioned to block off the opening. The cover housing 4 and the electric wire end covering section 7 of the main housing 3 hold an electric wire connection portion of the contact and the electric wires 6.

The body 8 covers a part of the main housing 3 and the entire surface of the cover housing 4 to cover both a boundary portion between the main housing 3 and the cover housing 4, and portions holding the electric wires 6.

A seal member 9 is integrally arranged on an outer circumferential face in the vicinity of the tip of the main housing 3. The seal member 9 is formed by, for example, insert-molding silicone rubber onto the outer circumferential face of the already-formed main housing 3. Further, the seal member 9 may also be formed simultaneously and integrally with the main housing 3 by two-color injection molding.

However, according to the above described waterproof electrical connector 1, there is a problem in that the body 8 becomes detached from the main housing 3 and the cover housing 4. When the body 8 detached, waterproofness of the waterproof electrical connector 1 is compromised.

One factor that causes the detachment of the body 8 is a result of oil included in the seal member 9. The oil is provided on the distal end portion of the main housing 3, and when a worker manually handles the main housing 3 and the cover housing 4 during the process of manufacturing and assembling the waterproof electrical connector 1. The oil adheres to portions to which the body 8 is to be attached(for example, portions denoted by reference character A in FIG. 5A) of the main housing 3 and the cover housing 4.

SUMMARY

The present invention has been accomplished in view of the above described technical problems, and an object of the present invention is to provide a waterproof electrical connector that can prevent the adherence of oil or the like to an attachment portion of a body to thereby prevent the peel-off of the body and make the waterproofness more reliable, as well as an assembly method of the waterproof electrical connector.

The connector includes a main housing, a cover housing, a contact, and a body. The main housing includes a mating protrusion, a fitting section, and a head portion. The contact includes a contacting portion that is received in the fitting section and an electric wire connection portion that connects to one end of an electric wire. The body covers at least a boundary portion between the main housing and the cover housing. The main housing further includes an outer circumferential wall positioned on an outer circumferential side of the boundary portion between the main housing and the cover housing.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENT(S)

The present invention is described in detail hereunder based on an embodiment that is illustrated in the attached drawings.

Figure 1A:
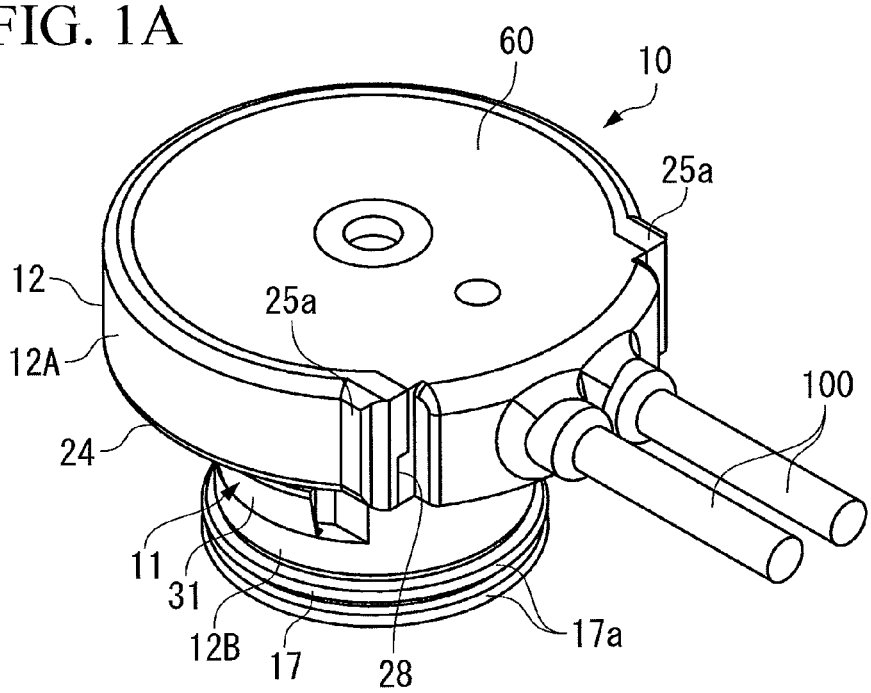
FIG. 1A is a perspective view of a squib connector according to the invention viewed from a face side opposite to the fitting face.
Figure 1B:
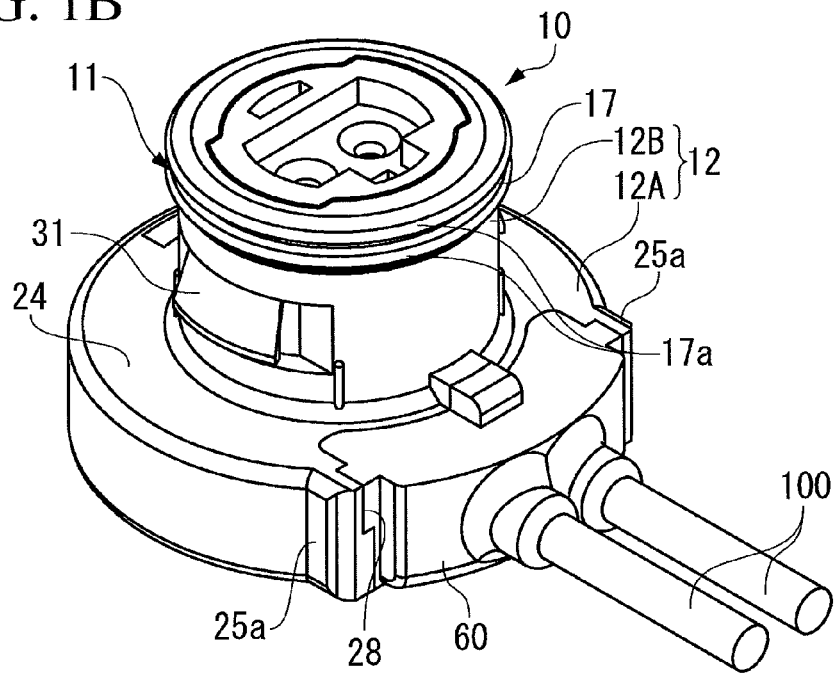
FIG. 1B is a perspective view of the squib connector viewed from a fitting face side.

With reference to FIG. 1A and 1B, the outer appearance of a squib connector (waterproof electrical connector) 10 according to the invention is shown.

The squib connector 10 connects electric wires 100 to a mating connector (not shown) provided in an ignition device of a vehicle airbag.

The squib connector 10 includes an insulative housing 11, a seal member 17, and a body 60.

Figure 2A:
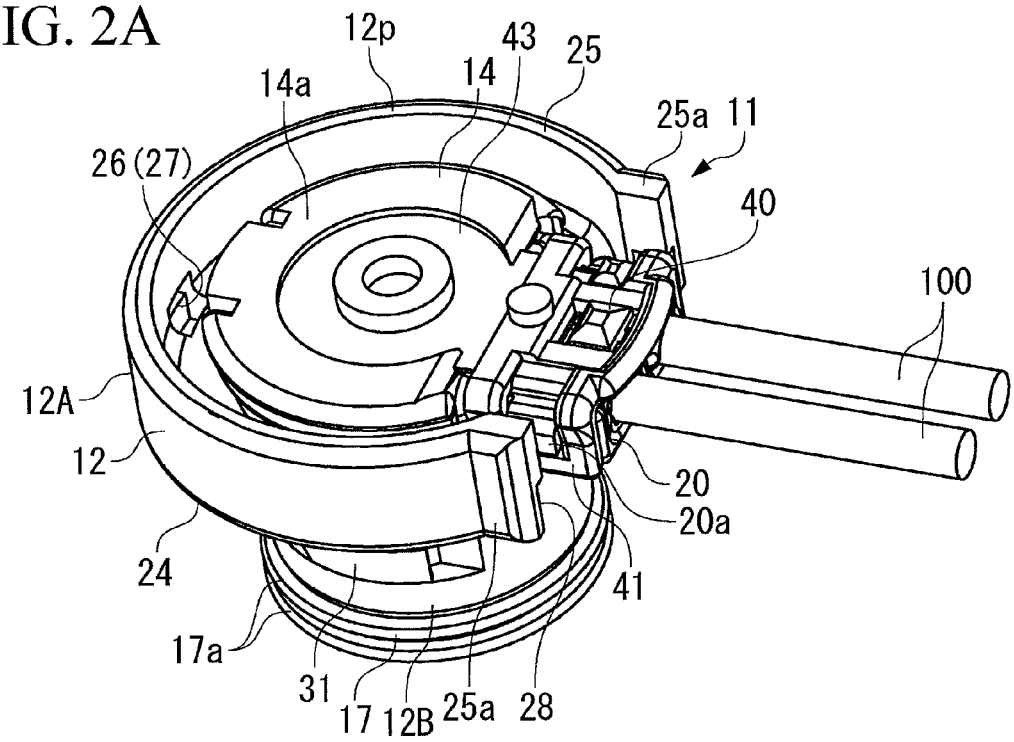
FIG. 2A is a perspective view of the squib connector viewed from the surface side opposite to the fitting face in the state.
Figure 2B:
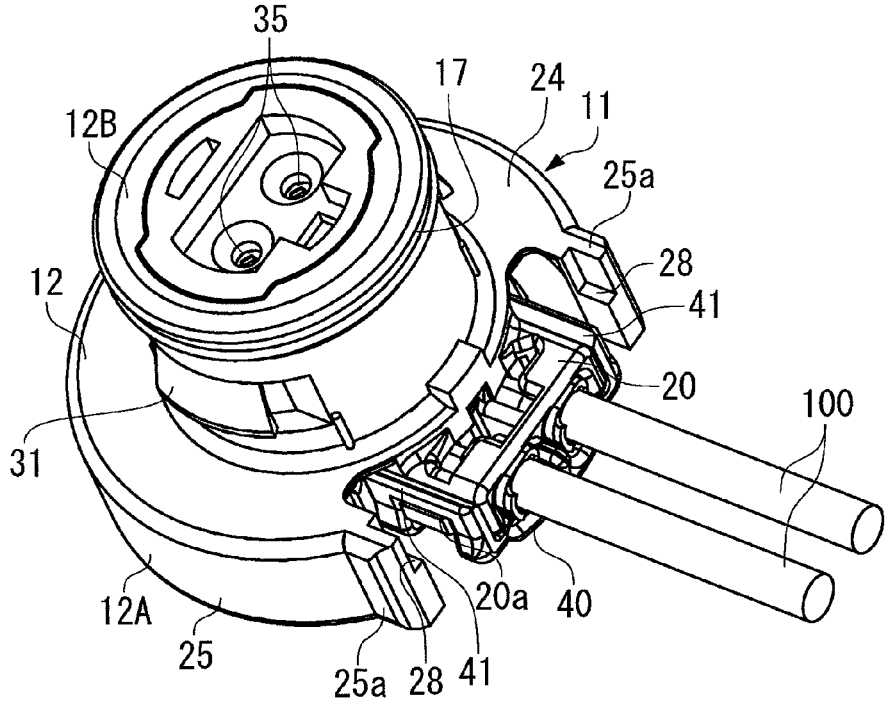
FIG. 2B is a perspective view of the squib connector viewed from the fitting face side in a state before a body is formed on the squib connector.

As shown in FIG. 2, the insulative housing 11 comprises a main housing 12 and a cover housing 14 that are both made of an insulating synthetic resin.

Figure 3:
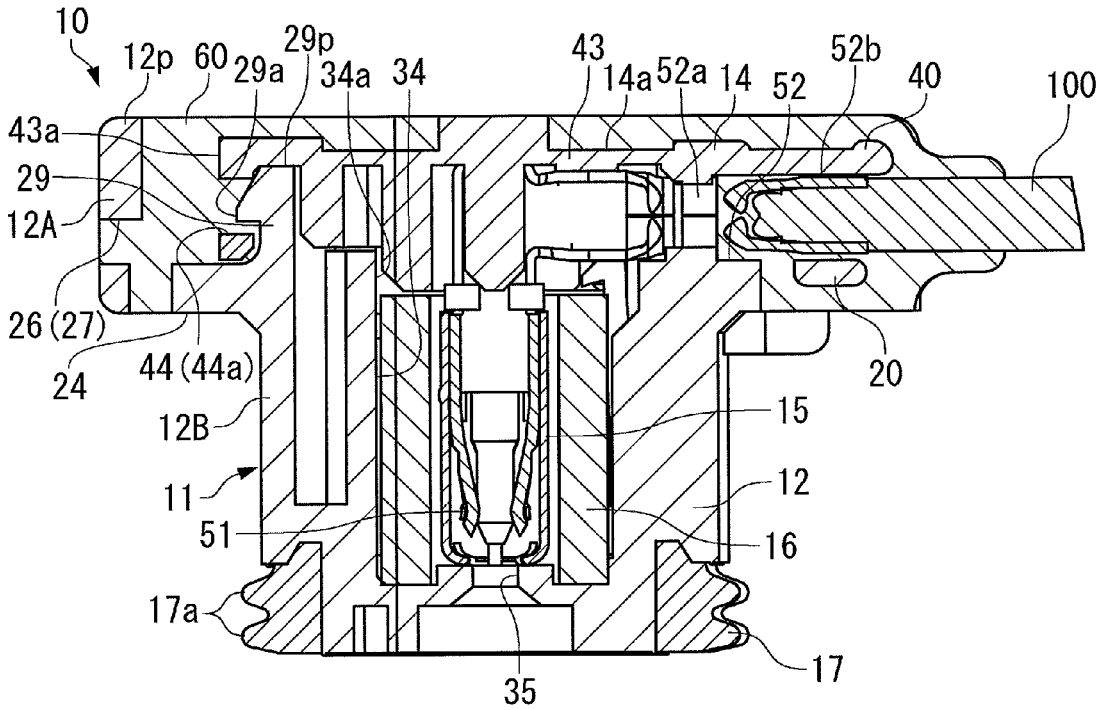
FIG. 3 is a sectional view of the squib connector.
Figure 4A:
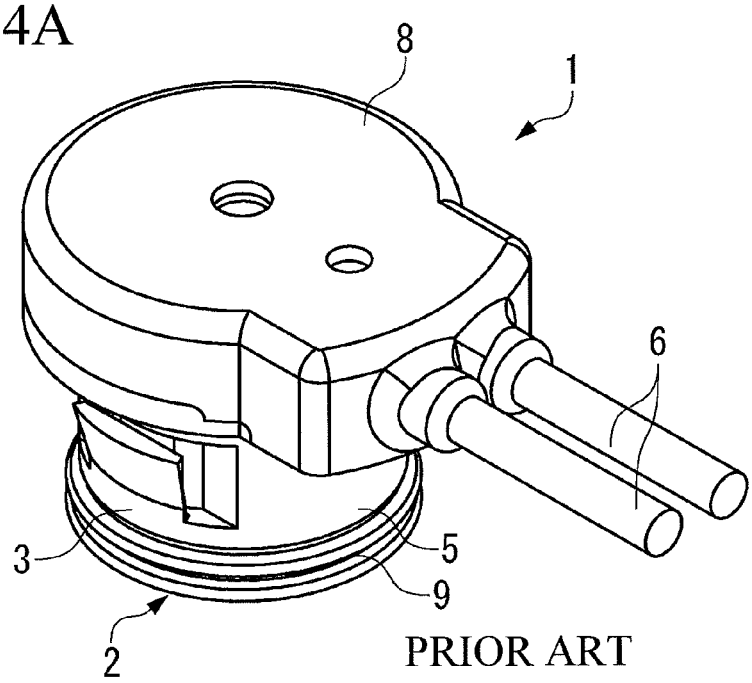
FIG. 4A is a perspective view of a known squib connector as seen from the side of a head portion thereof.
Figure 4B:
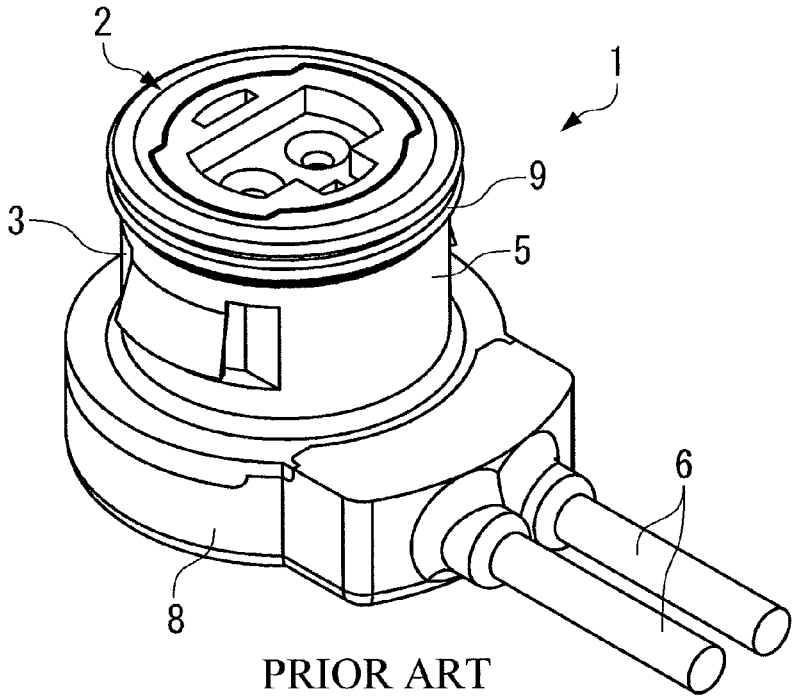
PRIOR ART FIG. 4B
FIG. 4B is a perspective view of the known squib connector as seen from a mating surface side.
Figure 5A:
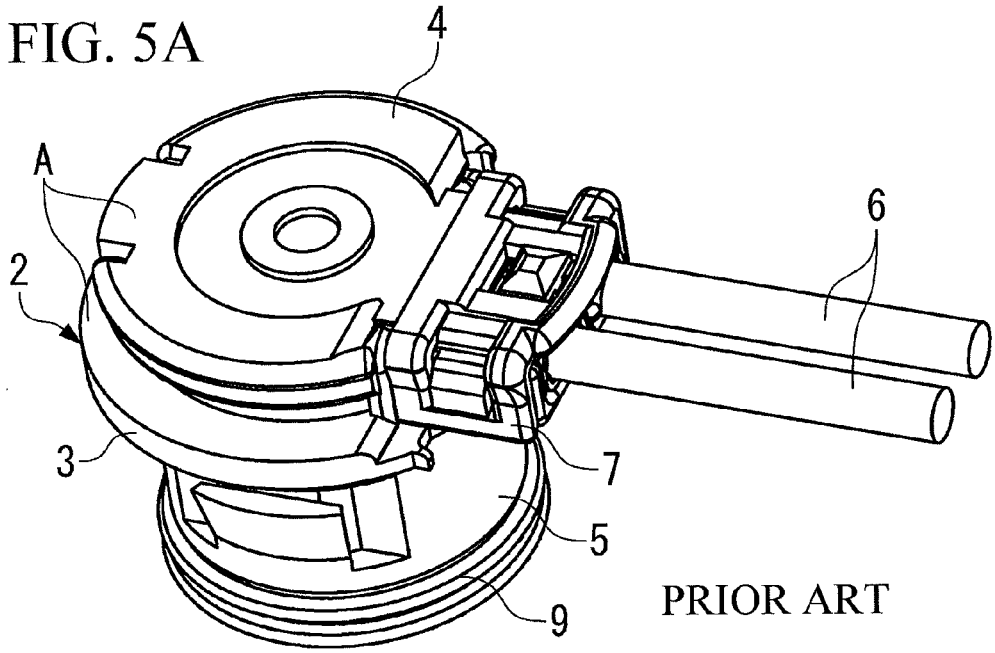
FIG. 5A is a perspective view of the known squib connector as seen from a head portion side of a main housing.
Figure 5B:
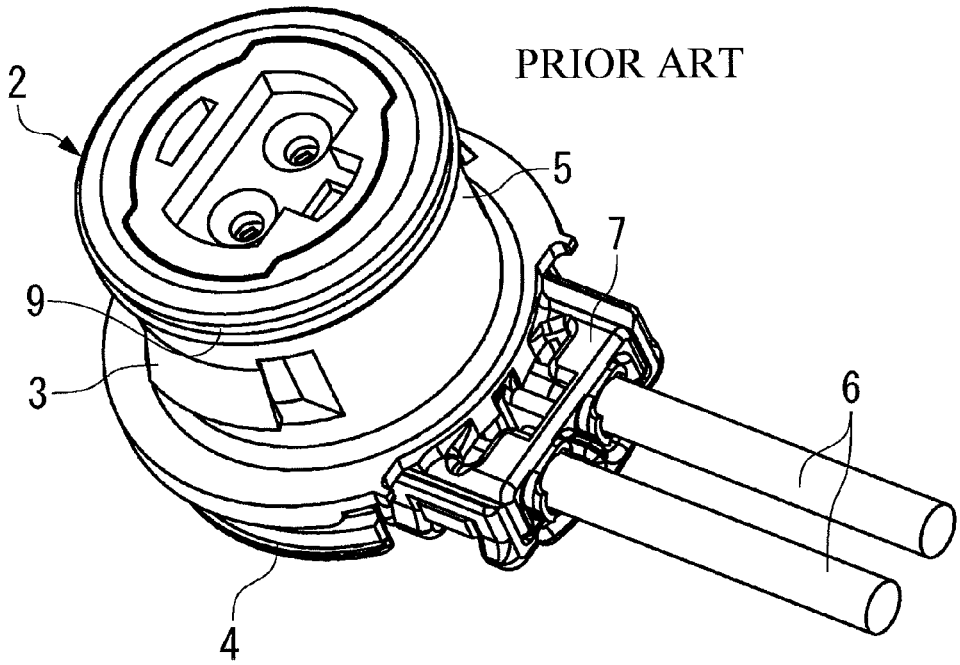
FIG. 5B is a perspective view of the known squib connector as seen from a mating surface side of the main housing.

As shown in FIG. 3, a contact 15 that is connected to an end of each of the insulatively-coated electric wires 100 and a ferrite core 16 for noise absorption are provided inside the insulative housing 11 of the squib connector 10.

In the embodiment shown, the contact 15 is a female contact that mates with a male contact of the mating connector, and is a member formed by stamping, bending, and plating a metal plate. The contact 15 is approximately L-shaped, and includes a contacting portion 51 which contacts the male contact of the mating connector, and an electric wire connection portion 52 that connects to one end of the electric wire 100. The electric wire connection portion 52 has a core wire crimping portion 52*a* which crimps a core wire of the electric wire 100, and an insulating coating crimping portion 52*b* that crimps an insulating coating of the electric wire 100.

The ferrite core 16 has a cylindrical shape, and is positioned on an outer circumferential side of the contacting portion 51 of the contact 15. The ferrite core 16 prevents electromagnetic noise from infiltrating from outside, and also prevents the leakage of electromagnetic noise to outside.

The main housing 12 of the insulative housing 11 includes a head portion 12A and a columnar mating protrusion 12B that extends in one direction from the head portion 12A and mates with a mating receiving section of the mating connector.

A contact receiving chamber 34 that extends in the axial direction of the mating protrusion 12B is formed in the head portion 12A and the mating protrusion 12B. The head portion 12A side of the contact receiving chamber 34 is open. The contacting portion 51 of the contact 15 and the ferrite core 16 are inserted into and received inside this opening 34*a* in the contact receiving chamber 34.

The tip of the mating protrusion 12B includes a connection receiving passageway 35 through which the contact receiving chamber 34 communicates with outside. When connecting the squib connector 10 to the mating connector, the male contact of the mating connector is inserted into the contact receiving chamber 34 through the connection receiving passageway 35 and comes in contact with the contact 15.

As shown in FIG. 2, a lock 31 is positioned on the outer circumferential face of the mating protrusion 12B of the main housing 12. The lock 31 prevents the mating protrusion 12B from coming loose from the contact-receiving concavity when the mating protrusion 12B is inserted into the contact-receiving concavity up to a predetermined position. The lock 31 is integrally formed with the main housing 12.

The head portion 12A includes an electric wire end covering section (supporting portion) 20 that protrudes in an orthogonal direction to the mating direction with the mating connector. The electric wire end covering section 20 receives the electric wire connection portion 52 that is connected to one end of each electric wire 100, that is led out in an orthogonal direction to the mating direction with the mating connector.

The head portion 12A includes a flange portion 24 that projects to the outer circumferential side at a position that is separated by a predetermined dimension on the mating protrusion 12B side from a top portion 29*p* of a cylindrical wall 29 forming the opening of the contact receiving chamber 34. The flange portion 24 is continuously formed in the circumferential direction of the head portion 12A, excluding a portion at which the electric wire end covering section 20 is formed.

An outer circumferential wall 25 that rises towards an opposite side to the mating protrusion 12B is formed at a peripheral portion of the flange portion 24. The outer circumferential wall 25 includes a top portion 12*p* that is located at a position that is further on the opposite side to the protruding direction of the mating protrusion 12B than the top portion 29*p* of the cylindrical wall 29 in the main housing 12. The top portion 12*p* is preferably formed to protrude towards the opposite side to the mating protrusion 12B to a level equal to or more than a top face 14*a* of the cover housing 14.

A material receiving passageway 26 that penetrates the outer circumferential wall 25 in the thickness direction thereof is formed in at least one place in the outer circumferential wall 25. The material receiving passageway 26 is used as a gate hole 27 for injecting a material in a molten state into a mold to form a body 60 as described later. Although the gate hole 27 may be formed at any position, preferably the gate hole 27 is formed on a side that is away from the electric wire end covering section 20.

The outer circumferential wall 25 may include a plurality of the material receiving passageways 26. In this case, it is preferable that the material receiving passageways 26 are formed with spaces there between in the circumferential direction of the outer circumferential wall 25.

Two end portions 25*a* of the outer circumferential wall 25 are positioned to extend in parallel with the direction in which the electric wire end covering section 20 extends. Mating depressions (second recesses) 28 are formed on the mating protrusion 12B side of the two end portions 25*a* and 25*a* and face the electric wire end covering section 20. The body 60 meshes with the mating depression 28 to thereby prevent the peel-off of the body 60.

In the head portion 12A of the main housing 12, the cover housing 14 of the insulative housing 11 has an opening covering portion 43 that covers the opening 34*a* for inserting the contact 15 into the contact receiving chamber 34. An outer circumferential portion (overhanging portion) 43*a* of the opening covering portion 43 extends in a cylindrical shape from the flange portion 24 of the head portion 12A of the main housing 12, and has an outer diameter that is larger than the cylindrical wall 29 forming the opening of the contact receiving chamber 34. The cylindrical wall 29 includes a latching projection 29*a* that protrudes to the outer circumferential side and that is located on an opposite side to the electric wire end covering section 20. The opening covering portion 43 includes a lock portion 44 that extends to the flange portion 24 side, and the lock portion 44 having a lock hole 44*a* that engages with the latching projection 29*a*. Thus, the cover housing 14 is latched to the head portion 12A of the main housing 12 on an opposite side to the electric wire end covering section 20.

The cover housing 14 also includes an electric wire end covering portion 40 that covers the electric wire end covering section 20 of the main housing 12. A fastener 41 is formed at both ends of the electric wire end covering portion 40. The fasteners 41 secure the cover housing 14 from displacement from the head portion 12A by engaging with a latching claw 20*a* formed in the electric wire end covering section 20.

The insulative housing 11 holds the electric wire connection portion 52 of the contact 15 and the electric wires 100 between the electric wire end covering section 20 of the main housing 12 and the electric wire end covering portion 40 of the cover housing 14.

The body 60 is formed to be integral with the insulative housing 11 through molding. At that time, the body 60 is formed using employing the material receiving passageway 26 formed in the outer circumferential wall 25 as the gate hole 27, and injecting material in a molten state into a mold from the gate hole 27.

The body 60 is formed by taking the outer circumferential wall 25 as a mold for the outer circumferential side thereof, and filling the material into the inner side thereof up to a level that is the same as an upper end face of the outer circumferential wall 25. After the body 60 has hardened, a portion thereof that has been filled into the material receiving passageway 26 is engaged with the outer circumferential wall 25. If a material receiving passageway 26 other than the gate hole 27 is also formed, the body 60 also enters into the material receiving passageway 26 and engages therewith. Thus, the peel-off of the body 60 on a side that is away from the electric wire end covering section 20 is prevented.

Further, on the electric wire end covering section 20 side, the body 60 interconnects with the mating depression 28 formed in the two end portions 25*a* and 25*a* of the outer circumferential wall 25 to thereby prevent the peel-off of the body 60 on the electric wire end covering section 20 side.

Furthermore, in the cover housing 14 that is latched to the head portion 12A of the main housing 12, the outer circumferential portion 43*a* of the opening covering portion 43 projects more to the outer circumferential side than the cylindrical wall 29 of the head portion 12A of the main housing 12. The body 60 engages with the projecting portion of the opening covering portion 43, and thus the peel-off of the body 60 is also prevented thereby.

The body 60 formed in this manner covers a portion of the main housing 12 and the entire surface of the cover housing 14, covering both a boundary portion between the main housing 12 and the cover housing 14 and a portion that holds the led-out electric wires 100. That is, the insulating coating of each of the electric wire 100 is attached to the insulative housing 11 by the body 60.

For example, according to one embodiment, a polyamide hot melt material or a polyester hot melt material is used as the material for the body 60. The material for the body 60 is not limited to the aforementioned materials, and any material may be used as long as the material can be molded to be integral with the insulative housing 11 by molding, can be molded at a low pressure in a short period of time, and has a high affinity for a resin material that forms the insulative housing 11 and does not adhere to the mold.

The seal member 17 is integrally arranged on an outer circumferential face in the vicinity of the tip of the mating protrusion 12B. The seal member 17 has an annular shape to surround a part of an outer circumferential face, and lip portions 17*a* are formed on the outermost periphery thereof. The lip portions 17*a* protrude further to the outer circumferential side than the outer circumferential face of the mating protrusion 12B. The outer diameter of the seal member 17 is larger than the inner diameter of the contact-receiving concavity of the mating connector. That is, the seal member 17 is formed to be in close and elastic contact with an inner wall of the contact-receiving concavity when the mating protrusion 12B is inserted into the contact-receiving concavity.

The seal member 17 is formed, for example, by insert-molding of silicone rubber onto an outer circumferential face of the already-formed mating protrusion 12B of the main housing 12. The silicone rubber adheres to the main housing 12 in the course of the insert-molding process, and thereby forms the seal member 17 that is integrated with the main housing 12.

The seal member 17 may also be formed simultaneously and integrally with the main housing 12 by two-color injection molding.

The squib connector 10 is manufactured as follows. First, the ferrite core 16 and the contact 15 that is connected to the electric wires 100 are inserted into the contact receiving chamber 34 of the main housing 12 and accommodated therein.

Next, the cover housing 14 is mounted to the main housing 12 to block off the opening 34*a* of the contact receiving chamber 34.

Thereafter, the insulative housing 11 is set inside a mold, the material for the body 60 is filled in a molten state into the inner side of the outer circumferential wall 25 from the gate hole 27 formed in the outer circumferential wall 25, and the material is hardened to obtain the squib connector 10.

In the above described squib connector 10, the outer circumferential wall 25 is provided to surround the outer circumferential side of portions at which the body 60 is to be attached to the main housing 12 and the cover housing 14. Therefore, it is possible to prevent a worker from contacting the attachment portions of the body 60 with a finger or the like when assembling the squib connector 10. Thus, oil contained in the seal member 17 can be prevented from adhering to the body 60, and the body 60 can be reliably attached.

Further, the outer circumferential portion of the body 60 is not exposed because the outer circumferential wall 25 is provided in the head portion 12A of the main housing 12. Therefore, it is possible to prevent an external force from being applied to the body 60 and causing the peel-off of the body 60.

Further, even if an external force is applied from the side of the electric wires 100, the peel-off of the body 60 can be reliably prevented by means of the friction between the inner circumferential face of the outer circumferential wall 25 and the body 60, the engagement between the material receiving passageway 26 of the outer circumferential wall 25 and the body 60 that has entered therein, the engagement between the mating depression 28 of the outer circumferential wall 25 and the body 60, and the engagement between the outer circumferential portion 43*a* of the opening covering portion 43 of the cover housing 14 and the body 60 on the inner circumferential side of the outer circumferential wall 25.

Thus, displacement of the body 60 can be prevented, and the waterproofness of the squib connector 10 can be made more reliable.

Although the present embodiment describes an example in which the waterproof electrical connector of the invention is the squib connector 10, the invention is not limited thereto, and can also be applied to a waterproof electrical connector used for other purposes.

Further, although the present embodiment describes the detailed structure of respective portions of the main housing 12 and the cover housing 14 constituting the squib connector 10, the configuration of portions other than the flange portion 24, the outer circumferential wall 25, and the body 60 may correspond to the relevant configurations described in Japanese Patent Laid-Open No. 2009-200010. Furthermore, any structure may be adopted as long as the outer circumferential wall 25 is positioned in the main housing 12, and the body 60 is positioned on the inner side of the outer circumferential wall 25.

In addition, although the present embodiment adopts a configuration in which the outer circumferential wall 25 includes the material receiving passageway 26, and the body 60 is engaged with the outer circumferential wall 25 by the entry of the material for the body 60 into the material receiving passageway 26, the number and shape of the material receiving passageways 26 are not limited in any way. Further, a configuration may be adopted in which a recess or groove, and not the material receiving passageway 26, is formed in the inner wall face of the outer circumferential wall 25.

Furthermore, with respect to the outer circumferential wall 25, a configuration may be adopted in which the outer circumferential wall 25 is cut off after forming the body 60.

It will be understood that, in addition to the foregoing, elements of the configuration described according to the above embodiment can be selectively omitted or adopted, or the configuration can be appropriately changed to another configuration without departing from the spirit of the invention.

What is claimed is:

1. A waterproof electrical connector, comprising:

a main housing having a mating protrusion, a contact receiving chamber positioned inside the mating protrusion, and a head portion having a flange portion projecting away from the contact receiving chamber and an opening positioned at a rear of the contact receiving chamber;

a cover housing that covers the head portion and the opening;

a contact having a contacting portion in the contact receiving chamber and an electric wire connection portion extending orthogonal to a mating direction;

a body covering at least an interior portion between the exterior surface of the contact receiving chamber and an outer circumferential edge of the flange portion; and an outer circumferential wall extending from a peripheral portion of the flange portion in a direction opposite the mating protrusion and toward the rear of the contact receiving chamber, and located on the outer circumferential edge portion of the flange.

2. The waterproof electrical connector according to claim 1, further comprising a material receiving passageway positioned on an inner circumferential face of the outer circumferential wall.

3. The waterproof electrical connector according to claim 2, wherein the material receiving passageway penetrates an inside and outside of the outer circumferential wall.

4. The waterproof electrical connector according to claim 3, wherein the material receiving passageway is a gate hole through which a material for the body is injected when forming the body.

5. The waterproof electrical connector according to claim 1, wherein the main housing includes a supporting portion extending orthogonal to the mating direction.

6. The waterproof electrical connector according to claim 5, wherein the outer circumferential wall is formed continuously around most of a circumference of the main housing except for a section where the supporting portion is positioned.

7. The waterproof electrical connector according to claim 6, wherein the outer circumferential wall includes a second recess facing the supporting portion on a side on which the mating protrusion is positioned.

8. The waterproof electrical connector according to claim 7, wherein the body is secured with the second recess.

9. The waterproof electrical connector according to claim 1, wherein the cover housing includes an overhanging portion projecting toward the outer circumferential side.

10. The waterproof electrical connector according to claim 9, wherein the body is secured with the overhanging portion.

11. The waterproof electrical connector according to claim 1, wherein the outer circumferential wall protrudes away from a protruding direction of the mating protrusion than the main housing and the cover housing positioned on the inner circumferential side of the outer circumferential wall.

* * * * *